United States Patent [19]

Coleman

[11] 4,053,424

[45] Oct. 11, 1977

[54] GREASE CONTAINING SYNERGISTIC EXTREME PRESSURE ADDITIVES

[75] Inventor: Richard L. Coleman, Port Arthur, Tex.

[73] Assignee: Texaco Inc., New York, N.Y.

[21] Appl. No.: 666,556

[22] Filed: Mar. 15, 1976

[51] Int. Cl.[2] ..... C10M 3/18; C10M 5/14; C10M 7/20; C10M 7/24

[52] U.S. Cl. ..... 252/32.7 E; 252/32.5; 252/21

[58] Field of Search ..... 252/32.5, 32.7 E, 21

[56] References Cited

U.S. PATENT DOCUMENTS 3,776,846 12/1973 Bailey et al. ..... 252/32.7 E
3,844,955 10/1974 Green ..... 252/21
3,914,179 10/1975 Byford et al. ..... 252/32.5

OTHER PUBLICATIONS

"Lubricant Additives" by Smalheer et al., 1967, The Lezius-Hiles Co., Cleveland, Ohio, p. 10.

*Primary Examiner*—Delbert E. Gantz
*Assistant Examiner*—Irving Vaughn
*Attorney, Agent, or Firm*—Carl G. Ries; Thomas H. Whaley; Kenneth R. Priem

[57] ABSTRACT

A grease compound of a base oil, a thickener, and minor synergistic amounts of the extreme pressure agent combination of zinc dialkyldithiophosphate, the reaction product of butyl acid phosphate and dodecyl aniline, and Bis($\beta$-chlorophenethyl) disulfide.

3 Claims, No Drawings

GREASE CONTAINING SYNERGISTIC EXTREME PRESSURE ADDITIVES

BACKGROUND OF THE INVENTION

1. Field of the Invention

This invention pertains to the field of lubricants, especially greases.

2. Description of the Prior Art

It is desirable in the selection of greases to consider the environment that the greases will have to operate under and in many cases, to select a grease which has properties which will allow it to perform adequately where two surfaces come together with considerable force. This force makes it very difficult to keep a lubricant in place and prevent the two surfaces from actually touching each other. A lubricant between these surfaces must possess a property known as extreme pressure (EP) tolerance. This property allows a lubricant to continue to lubricate the two surfaces even though the bulk of the grease is forced out from between the surfaces. The art has many references to additives which impart extreme pressure properties to greases. It was surprising, however, to discover that a particular combination of additives imparted synergistic extreme pressure properties to greases. That is, the extreme pressure properties of the resulting grease having the combination of additives as disclosed by applicant, are superior to greases containing only one or two components of the proposed three component additive combination. By using the additive combination disclosed hereinafter, a grease may be obtained which has unexpectedly superior extreme pressure properties.

SUMMARY OF THE INVENTION

The invention is a lubricant, especially a grease, comprising a major amount of a lubricating oil, a thickener and a three component additive combination to impart synergistic extreme pressure properties. This three component additive combination consists of zinc dialkyldithiophosphate, Bis($\beta$-chlorophenethyl) disulfide and the reaction produce of butyl acid phosphate and dodecyl aniline.

DESCRIPTION OF THE PREFERRED EMBODIMENTS

The lubricating oils forming the major component of the grease compositions claimed hereinafter may be any lubricating oil having Saybolt Universal viscosities in the range of from about 75 seconds at 100°F (75SUS/100°F) to about 225 seconds at 210° F, which may either naphthenic or paraffinic in type, or blends comprising both naphthenic and paraffinic oils. The preferred lubricating oils are those having Saybolt Universal viscosities in the range of from about 300 seconds at 100° F to about 100 seconds at 210° F, which may be blends of lighter and heavier ols in a lubricating oil viscosity range. Synthetic lubricating oils which may be preferred in preparing greases having particular properties required for special types of lubricating services, include oils prepared by cracking and polymerizing products of the Fischer-Tropsch process and the like as well as other synthetic oleaginous compounds such as polyethers, polyesters, silicon oils, etc. having viscosities within the lubricating oil viscosity range. Suitable polyethers include particularly polyalkylene glycols such as polyethylene glycol. Suitable polyesters include the aliphatic dicarboxylic acid diesters, such as di-2-ethyl-hexyl secabacate, di(secondary amyl) sebacate, di-2-ethyl-hexyl azelate, di-iso-octyl adipate, etc. The sulfur analogs of the polyalkylene esters and polyesters are also suitable.

Silicon polymer oils may also be employed, preferably having viscosities in the range from about 70 to 900 seconds Saybolt Universal at 100° F. Suitable compounds of this type include dimethyl silicon polymer, diethyl silicon polymer, methyl cyclohexyl silicon polymer, diphenol silicon polymer, methyl ethyl silicon polymer, methyltolyl silicon polymer, etc. The lubricating oils normally comprise from about 70 to 98 percent of the grease composition.

Generaly, two types of thickeners for the oils are used to form the greases: soaps and/or clays.

By the term soap base thickening agent as used herein, it is meant metal soaps of fatty acids which are capable of providing a stable gell structure to lubricating base oils. The term soap is intended to include conventional metal soaps, complex soaps, mixed base soap greases, and the like, and to include, for example, the following particular types of soap thickeners:

Metal Base

Aluminum base
Barium base
Calcium base
Lithium base
Sodium base
Lead base
Strontium base Mixed Bases Sodium-calcium base
Sodium-barium base
Calcium-aluminum base
Magnesium-aluminum base
Lithium-aluminum base
Lithium-calcium base Sodium-Aluminum Base Metal Complex Hydrated calcium soap
Hydrated aluminum soap
Hydrated barium soap
Hydrated lithium soap
Hydrated sodium soap
Hydrated strontium soap
Complex aluminum soap
Complex barium soap
Aluminum-barium complex
Aluminum-sodium complex
Complex calcium soap
Calcium soap-calcium acetate complex
Calcium soap-calcium chloride complex
Calcium soap-strontium hydrate complex
Calcium-barium soap complex
Complex lithium soap
Lithium soap-lithium acetate
Lithium soap-lithium acelate complex
Magnesium soap complex
Lead soap complex
Sodium soap-sodium acetate complex
Sodium soap-sodium acrylate complex
Sodium-barium complex
Strontium-calcium acetate complex Though the lubricating base oil component of the invention can be either a natural or synthetic oil, as a practical matter, the base oil will usually be a natural oil, e.g., a petroleum-derived mineral oil. Many synthetic oils such as silicone oils and various esters can be thickened effectively with soap thickeners; however, the thermal stability of soaps is usually considerably lower than that of the synthetic oils. Therefore, there is usually no point in using expensive synthetic oils with soap greases. Exceptions to this, however, are some of the complex greases which possess considerably higher thermal stability than the conventional soap-base greases.

The clays which are useful as thickeners for the preparation of greases are oleophilic clay products exhibiting a substantial base exchange capacity. The clays particularly contemplated herein include especially the montmorillonites, such as socium, potassium, lithium, and the other bentonites, particularly of the Wyoming bentonite type. Still more preferred are the magnesium bentonites, sometimes referred to as "Hectorites." These days are characterized by unbalanced crystal structure and are believed to have negative charges which are normally neutralized by inorganic cations. An especially preferred bentonite is that made by complexing finely particulated montmorillonite in aqueous media with dimethyldioctadecyl ammonium chloride using the techniques described in U.S. Pat. Nos. 2,531,427 and 2,531,440. This product can be purchased under the coined name "Bentone 34" from the Baroid Sales Division of National Lead.

The term "oleophilic clay product" is meant to include such clays when they have absorbed thereon or reacted therewith sufficient organic ammonia base to form an oleophilic product. The so-called "onium-clays" comprise reaction products of oleophilic amonium bases (or their salts) and clays.

The clays are more preferably modified by absorption of one or more oleophilic cationic surface-active agents such as those described in U.S. Pat. Nos. 2,831,809 and 2,874,152. The clays are preferably present in an amount sufficient to cause grease formation of the lubricating oil to occur. This will usually occur in the range of 2.5–10% by weight of the high base exchange clay (based on the inorganic clay portion of the oleophilic clay product) depending somewhat upon the precise clay employed, the chemical constitution of the major lubricating oil components and the proportions of other components present in the grease formulation.

The thickeners used in my invention normally comprise from about 3 to 10% of the grease.

The three component additive combination of this invention comprises 1. zinc dialkyldithiophosphate in an amount ranging from about 1 to 3 weight percent of the total lubricant mixture and preferably in an amount ranging from about 1.5 to 2.5 weight percent of the total lubricant mixture.

2. Bis(β-chlorophenethyl) disulfide in an amount ranging from about 1 to 3 weight percent of the total lubricant mixture and preferably in an amount ranging from about 1.5 to 2.5 weight percent of the total lubricant 3. The reaction product of butyl acid phosphate and dodecyl aniline. The composition of this reaction product is a mixture of monobutyl and dibutyl acid phosphates and dodecyl aniline in the form of a salt. Specificially, the reaction product is a salt of dodecyl aniline comprising about 70 weight percent, monlbutyl acid phosphate comprising about 13 weight percent and dibutyl acid phosphate comprising about 17 weight percent. The additive also includes trace amount of paraffin oils, water and butyl alcohol. This additive should be present in the lubricant in an amount ranging from about 0.2 to 1.0 weight percent of the total lubricant mixture and preferably in an amount ranging from about 0.4 to 0.6 weight percent of the total lubricant mixture.

In addition to the additive combination of this invention, other additives of the types ordinarily employed in lubricating compositions may be employed in these greases such as oxidation inhibitors, corrosion inhibitors, and tackiness agents.

PREPARATION OF A TYPICAL GREASE OF THE INVENTION

A suggested procedure for making a grease of my invention includes the following steps:

1. Lithium hydroxide and a fat are saponified in the presence of a portion of the base oil with stirring.
2. The mixture is heated with stirring above the melting point of the soap formed in (1), above and then quenched with additional base oil.
3. Any additional base oil is then added as the mixture is stirred and the additives are then added.
4. The grease mixture may then be passed through a colloid mill to further disperse the soap.

The procedure above is only suggested. Any method for making grease accepted in the art may be used. The invention is not restricted to my particular method of making grease.

EXPERIMENTAL

Greases were made as described above from an uninhibited lithium soap base and the additive combinations shown below. As may be seen, the three component system gave test results superior to any grease made with the same amount of any two of the additives.

| | GREASE | | | |
|---|---|---|---|---|
| INGREDIENTS, WT. % | A | B | C | D |
| Base oil* | 87.9 | 87.9 | 87.9 | 87.9 |
| Lithium Soap | 7.6 | 7.6 | 7.6 | 7.6 |
| Reaction Product of butyl acid phosphate and dodecylaniline | 0.5 | 0.5 | — | 0.5 |
| Bis(β-chlorophenethyl) disulfide | 4.0 | 2.0 | 2.0 | — |
| Zinc Dialkyldithio-phosphate | — | 2.0 | 2.5 | 4.0 |
| Tests: | | | | |
| Load Wear Index, Kg. | 70.6 | 73.2 | 61.7 | 50.1 |
| Weld Point, Kg. | 316 | 398 | 316 | 251 |
| Timken, OK, lb. | 35 | 45 | 35 | |

*Parraffinic oil of about 1000 SUS/100° F.

The data below indicate the effect of the additive package in grease B above at different concentrations:

| | GREASE | | |
|---|---|---|---|
| INGREDIENTS, WT. % | B | E | F |
| Base oil* | 87.9 | 87.9 | 87.9 |
| Lithium Soap | 7.6 | 7.6 | 7.6 |
| Reaction Product of butyl acid phosphate and dodecylaniline | 0.5 | 0.5 | 0.5 |
| Bis(β-chlorophenethyl) disulfide | 2.0 | 3.0 | 1.0 |
| Zinc Dialkyldithio phosphate | 2.0 | 2.0 | 3.0 |
| Tests: | | | |
| Load Wear Index, Kg. | 73.2 | 63.5 | 47.6 |
| Weld Point, Kg. | 398 | 251 | 316 |
| Timken, Kg | 45 | 30 | 40 |

I claim:

1. A grease comprising a. a major amount of a lubricating oil, b. a thickener, c. the reaction product of butyl acid phosphate and dodecylaniline in an amount ranging from about 0.4 to 0.6 weight percent of the total mixture, d. Bis(β-chlorophenethyl) disulfide present in an amount ranging from about 1.5 to 2.5 weight percent of the total mixture, and e. zinc dialkyldithiophosphate in an amount ranging from 1.5 to 2.5 weight percent of the total mixture.

2. A grease comprising a. a major amount of a paraffinic lubricating oil, b. a soap thickener, c. the reaction product of butyl acid phosphate and dodecylaniline in an amount ranging from about 0.4 to about 0.6 weight percent;

d. Bis(β-chlorophenethyl) disulfide in an amount ranging from about 1.5 to 2.5 weight percent; and e. zinc dialkyldithiophosphate in an amount ranging from about 1.5 to 2.5 weight percent of the total mixture.

3. A grease comprising a. a major amount of a lubricating oil, b. a thickener, c. about 0.5 weight percent based on the total mixture of the reaction product of butyl acid phosphate and dodecylaniline, d. about 2.0 weight percent based on the total mixture of zinc dialkyldithiophosphate, e. about 2.0 weight percent based on the total mixture of Bis (β-chlorophenethyl) disulfide.

* * * * *